US005813211A

United States Patent [19]

Stahlecker

[11] Patent Number: 5,813,211

[45] Date of Patent: Sep. 29, 1998

[54] FEEDING AND OPENING DEVICE FOR AN OPEN-END SPINNING ARRANGEMENT

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 928,629

[22] Filed: Sep. 12, 1997

[30] Foreign Application Priority Data

Sep. 24, 1996 [DE] Germany ..... 196 39 112.1

[51] Int. Cl.[6] ..... D01H 4/00

[52] U.S. Cl. ..... 57/412; 57/406

[58] Field of Search ..... 57/406, 407, 408, 57/412; 19/105

[56] References Cited

U.S. PATENT DOCUMENTS

| | | | |
|---|---|---|---|
| 3,884,028 | 5/1975 | Stahlecker et al. | 57/412 |
| 3,924,397 | 12/1975 | Stahlecker et al. | 57/408 |
| 3,983,310 | 9/1976 | Didek et al. | 57/412 |
| 4,096,686 | 6/1978 | Stahlecker et al. | 57/406 |
| 4,098,065 | 7/1978 | Stahlecker et al. | 57/58.95 |
| 4,459,801 | 7/1984 | Stahlecker et al. | 57/412 |
| 5,185,994 | 2/1993 | Stahlecker | 57/412 |

FOREIGN PATENT DOCUMENTS

| | | | |
|---|---|---|---|
| 3500511A1 | 8/1985 | Germany . | |
| 62-50580 | 10/1987 | Japan | 57/412 |

*Primary Examiner*—William Stryjewski

*Attorney, Agent, or Firm*—Evenson McKeown Edwards & Lenahan PLLC

[57] ABSTRACT

In the case of a feeding and opening device for an open-end spinning arrangement, a stationarily mounted sliver support is arranged at the end of the sliver to be opened to single fibers. The sliver support comprises a deflecting edge for deflecting the sliver, and a supporting surface, which presses the end of the sliver somewhat tangentially onto the opening roller. The sliver support is exchangeably affixed to an opening roller housing, which consists of two housing parts, between which the sliver support is clamped without gaps. One housing part serves essentially to support the opening roller and the other housing part serves essentially to cover the peripheral side of the opening roller.

14 Claims, 4 Drawing Sheets

FEEDING AND OPENING DEVICE FOR AN OPEN-END SPINNING ARRANGEMENT

BACKGROUND AND SUMMARY OF THE INVENTION

This application claims the priority of German application 196 39 112.1 filed in Germany on Sep. 24, 1997, the disclosure of which is expressly incorporated by reference herein.

The present invention relates to a feeding and opening device for an open-end spinning arrangement comprising a feed roller for feeding a sliver, an opening roller rotating in an opening roller housing for opening the sliver to single fibers, a feed table for pressing the sliver flexibly to the feed roller, and a sliver support arranged between the feed table and the opening roller and mounted stationarily on the opening roller housing while being detachable therefrom. The said sliver support is provided with a deflecting edge for deflecting the sliver and with a supporting surface for pressing the end of the sliver slightly tangentially onto the opening roller.

In the case of a feeding and opening device of this type (U.S. Pat. No. 5,185,994), the sliver support is arranged stationarily with respect to the opening roller housing. Further details as to the type of attachment or a reference to the purpose of exchangeability are not made in this publication. The known form has the advantage in that it is not a movable feed table which determines the point at which the sliver reaches the opening means of the opening roller, but rather a stationary sliver support, so that conditions at the opening roller do not alter when the feed table moves.

It is further known (DE 35 00 511 A1) to construct a sliver support, stationary in operation, to adapt to different fiber materials by making it exchangeable. This known sliver support is arranged hereby at a supporting holder which also supports the feed table, so that the sliver support can be swivelled away from the opening roller in the case of an end break.

Finally, it is also known (U.S. Pat. No. 4,098,065) that individual fiber guiding surfaces are detachably arranged at a base plated shaped opening roller housing for easier production. A sliver support which is independent of the feed table is not provided.

It is an object of the present invention to attach a detachable sliver support to an opening roller housing, which sliver support is arranged stationarily during operation, and to construct the opening roller housing accordingly for this purpose.

The object has been achieved in accordance with the present invention in that the opening roller housing consists of at least two housing parts and that the sliver support is exchangeably mounted on both housing parts.

One housing part serves to attach the opening roller housing as a whole to the open-end spinning arrangement and supports the bearing of the opening roller as well as the other housing part. The other housing part serves essentially to cover the periphery of the opening roller and is provided accordingly for this purpose with yarn guiding surfaces. As the sliver support is mounted on both housing parts, the sliver support can be clamped along its lateral surfaces without leaving a gap, so that the settling of fly accumulation on the sliver support is prevented to a great extent.

Each housing part is advantageously provided with supporting surfaces for a lateral face of the sliver support. The distance between the supporting surfaces is advantageously spanned by two through bolts mounted in the housing parts. A through bore hole of the sliver support is arranged for one through bolt, while a shell-shaped guiding surface of the sliver support is arranged at the other through bolt. This results in the advantage that only one through bolt needs to be released in order to exchange the sliver support, while it is sufficient just to loosen somewhat the second through bolt arranged at the shell-shaped guiding surface. The through bolt arranged at the through bore hole serves first and foremost to center the sliver support, while the other through bolt serves to adjust the sliver support laterally to the combing structure of the opening roller. To this end, the entire sliver support can be swivelled slightly around the centering through bolt, but only however in very small areas of a fraction of a millimeter.

Due to the advantageously mounted exchangeable sliver support, not only is adaptation to various spinning conditions and fiber material possible, but the sliver support itself can be made from different materials than the housing parts and, as required, can be provided with coatings which not only serve to protect against wear, but which also improve spinning conditions, for example. Such coatings are known which are especially provided for the sliver support so that the so-called "honey dew" present in the sliver tends to stick less to the deflecting edge.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
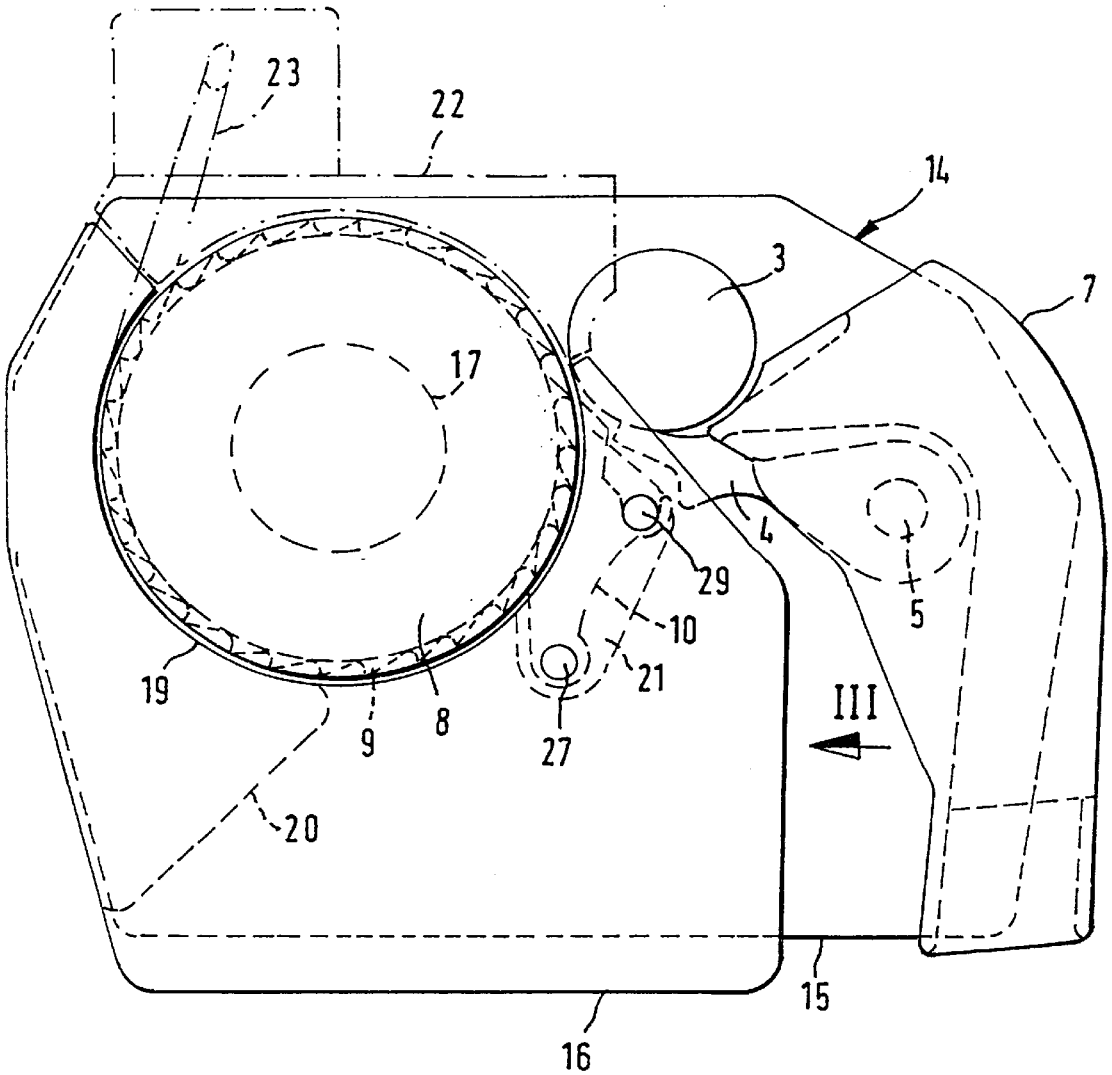
FIG. 1 is a view, from the operating side of the open-end spinning arrangement, showing a feeding and opening device comprising an opening roller housing and a sliver support applied exchangeably thereto, arranged according to the present invention.
Figure 2:
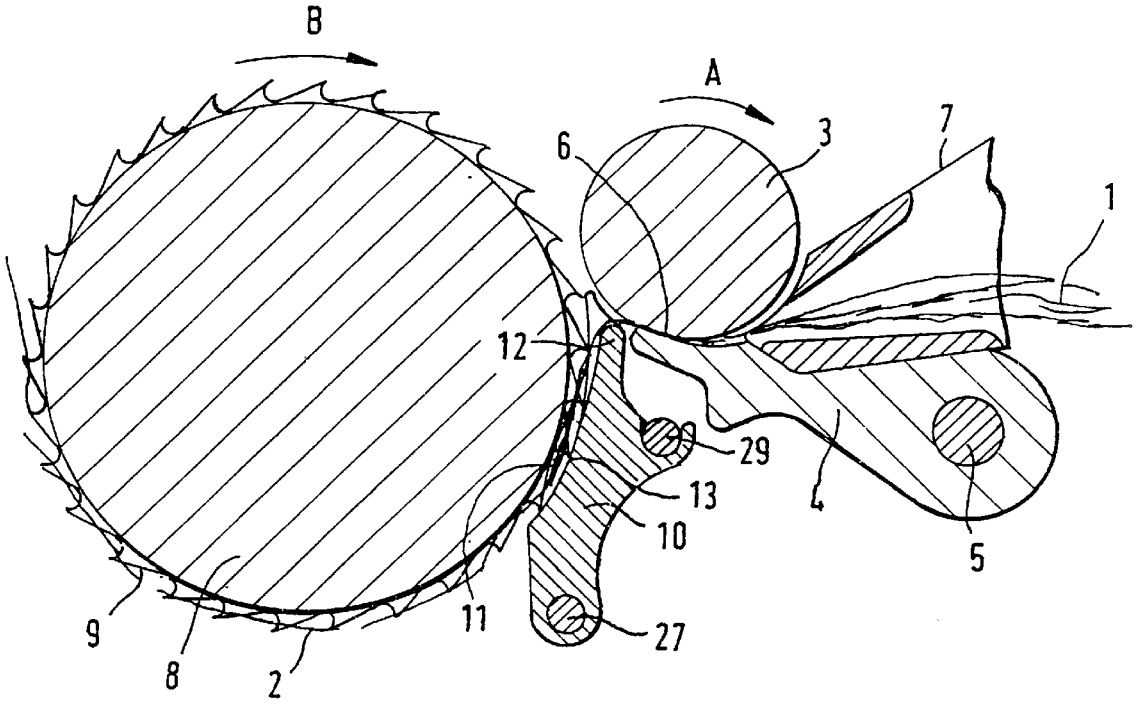
FIG. 2 is a cross sectional part view of FIG. 1 for the purpose of demonstrating the opening of a sliver to single fibers.
Figure 3:
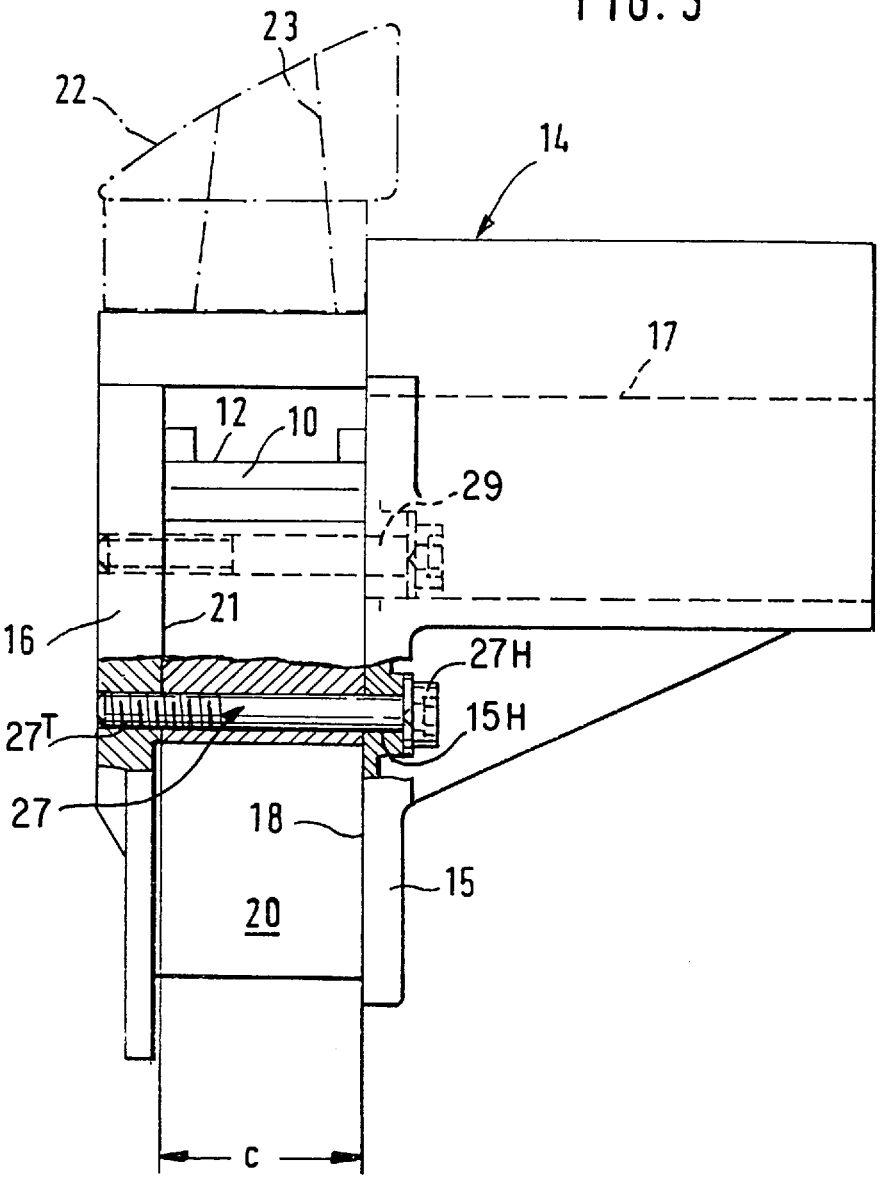
FIG. 3 is a view in arrow direction III of FIG. 1 of the opening roller housing comprising two housing parts and of the sliver support applied thereto.

The feeding and opening device shown in FIGS. 1,2 and 3 is, in a known way, part of an open-end spinning arrangement (not shown). The feeding and opening device serves to feed a sliver 1 and to open it to single fibers 2. Among other components, a feed roller 3 driven in rotational direction A is provided herefore, to which feed roller 3 a feed table 4 is resiliently pressable from below. The feed table 4 is weighted by a loading spring (not shown) around a swivel axle 5. Thus a nipping line 6 is formed between the feed roller 3 and the feed table 4, to which the sliver 1 is nipped during its transport movement. A feed condenser 7 for the sliver 1 is arranged upstream of the feed roller 3.

The feed roller 3 presents the sliver 1 to be opened with a significantly faster driven opening roller 8, which is driven in the same rotational direction B as the feed roller 3. The opening roller 8 is provided with combing structure 9 in a known way, which combing structure can be comprised of needles or saw-teeth or the like.

A sliver support 10 is stationarily arranged between the feed table 4 and the opening roller 8 in a way to be described below, which sliver support 10 presses the end 11 of the sliver 1 to be opened from the back side into the combing structure 9 of the opening roller 8. The sliver support 10 comprises a deflecting edge 12, which at the same time extends the supporting face of the feed table 4 at the nipping line 6, but which deflecting edge 12 does not make the swivel movements of the feed table 4, but rather always maintains the same position during operation. The sliver support 10 comprises further a supporting surface 13, which, downstream of the deflecting edge 12, is arranged somewhat tangentially to the opening roller 8 at a very small distance thereto. Thus the end 11 of the sliver 1 is held in the combing structure 9.

The above mentioned components are supported in an opening roller housing 14, which essentially consists of two housing parts 15 and 16.

The housing part 15 serves essentially to affix the entire opening roller housing 14 to a holding device (not shown) of the open-end spinning arrangement and further to support the opening roller 8. For this purpose, the housing part 15 is provided with a cylindrical receiver 17 for a bearing housing of the opening roller 8. The housing part 15 comprises further a plane supporting surface 18, on which the other housing part 16 is supported (not shown in detail).

The second housing part 16 serves essentially to cover the periphery of the opening roller 8 and comprises for this purpose at least one peripheral surface 19, which surrounds a part of the periphery of the opening roller 8. Furthermore, guiding surfaces 20 are applied to the housing part 16, for example for defining a known trash removal opening. Finally, the housing part 16 comprises supporting surfaces 21 for holding the sliver support 10 in a way to be described below.

The opening roller housing 14 may comprise further housing parts, for example a channel housing 22, denoted only by a dot-dash line, which is provided with a fiber feed channel 23. The opened single fibers 2 are fed in a known way through this fiber feed channel 23 to a twist device (not shown), for example a spinning rotor.

The above mentioned supporting surfaces 18 and 21 have a distance c between them, said distance c corresponding essentially to the effective width d of the sliver support 10. Thus the lateral surfaces 24 and 25 of the sliver support 10 (see also FIGS. 4 and 5) can be clamped between the plane and parallel supporting surfaces 18 and 21 without leaving a gap.

For the purpose of affixing the sliver support 10 to the opening roller housing 14, the sliver support 10 comprises a through bore hole 26, through which a through bolt 27 can be inserted. This through bolt 27 is supported by means of a screw thread 27T in the housing part 16, and is placed, in the area of its screw head 27H, through a corresponding bore hole 15H of the other housing part 15. Thus the sliver support 10 is supported exchangeably at both housing parts 15 and 16 of the opening roller housing 14.

The sliver support 10 is provided at a short distance to the through bore hole 26 with a shell-shaped guiding surface 28, which is allocated to a further through bolt 29. The second through bolt 29 is supported on both housing parts 15 and 16 in a similar way to the through bolt 27. When exchanging the sliver support 10 it is sufficient just to take out the through bolt 27 completely, while the other through bolt 29 need only be loosened. The through bolt 27 serves to fix the sliver support 10 at the open roller housing 14, while due to the minimal clearance of the shell-formed guiding surface 28 by means of the second through bolt 29, a slight lateral alignment of the sliver support 10 is possible. Thus the supporting surface 13 can be adjusted very exactly at a pre-given distance to the combing structure 9 of the opening roller 8. An adjusting roller for example can be provided which serves only the assembly of the sliver support 10, which adjusting roller can be applied temporarily in the opening roller housing 14 instead of the opening roller 8 and which has a slightly larger diameter than the opening roller 8. The sliver support 10, that is its supporting surface 13, is positioned with respect to the adjusting roller and fixed in this position.

Figure 5:
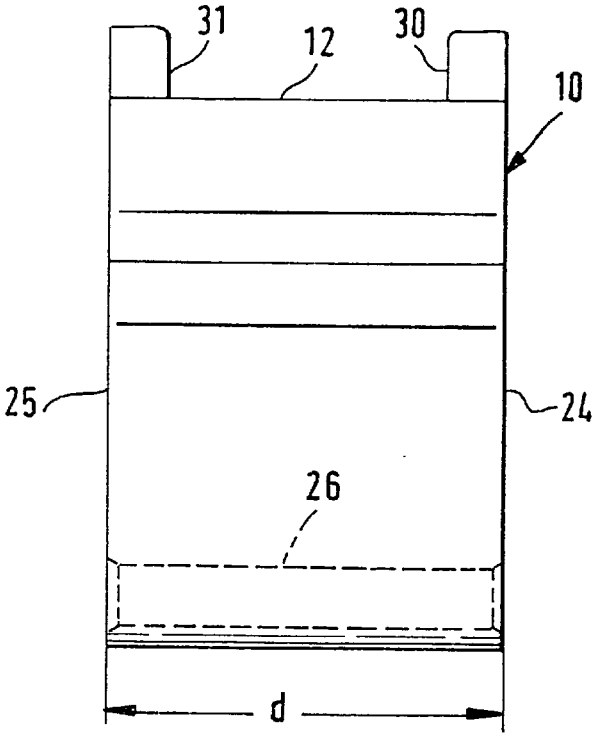
FIG. 5 is a view of the sliver support in the direction of arrow V of FIG. 4.
Figure 4:
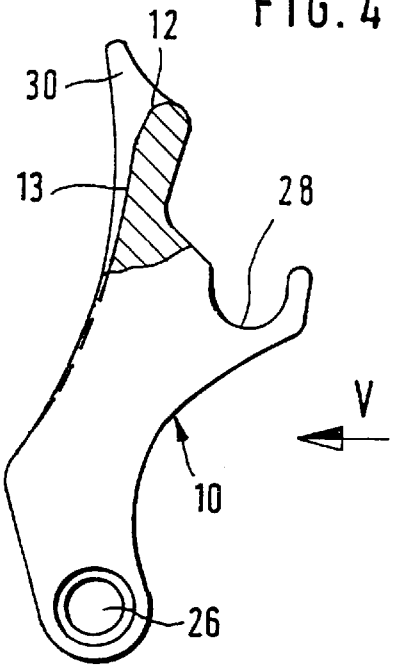
FIG. 4 is an enlarged view of a sliver support in the view according to FIG. 1.

As can be seen especially from FIGS. 4 and 5, the sliver support 10 has two lateral guides 30 and 31 in the area of the deflecting edge 12, so that the end 11 of the sliver 1 also cannot evade in lateral directions.

The multipart construction of the opening roller housing 14 as well as the exchangeably constructed sliver support 10 permit the sliver support 10 to be adapted to various spinning conditions and various fiber materials. It is also contemplated to make the sliver support 10 from another basic material than the one used for the housing parts 15 and 16 and/or to use other types of coating. For example, chemically nickel-plated zinc diecast parts are used for the housing parts 15 and 16. The sliver support 10, in contrast, is provided with another type of coating which not only serves as protection against wear, but which also improves the spinning conditions. For example, a coating can be provided which is less adherent for the sticky honey dew present in the sliver 1. Such a sliver support 10 coating can be obtained by hard chrome-plating, for which purpose the sliver support 10 is advantageously made of steel.

If the opening roller housing 14 were made of a one-piece diecast part, then such exact adaptations with respect to material and coating for the individual fiber guiding surfaces could not be made.

Figure 6:
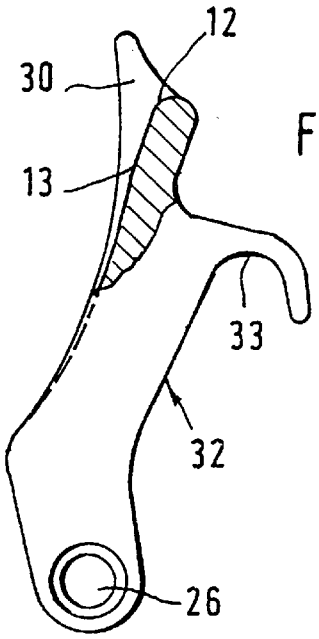
FIG. 6 is a view similar to FIG. 4, showing a sliver support constructed according to another preferred embodiment of the present invention.

FIG. 6 shows a slight variation in the form of the sliver support 32. It differs from the sliver support 10 described up to this point only in that the shell-formed guiding surface 33 is open not upwards, but downwards. During assembly, the sliver support 32 can thus be more easily hooked on to the allocated through bolt 29, and the sliver support 32 can, in addition, be used as a limit stop for the feed table 4 which can be swivelled away from the feed roller 3.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A feeding and opening device for an open-end spinning arrangement comprising:

a feed roller for feeding a sliver, an opening roller rotating in an opening roller housing for opening the sliver to single fibers, a feed table for pressing the sliver flexibly against the feed roller, and a sliver support stationarily arranged between the feed table and the opening roller and applied detachably to the opening roller housing, which sliver support is provided with a deflecting edge for deflecting the sliver and with a supporting surface which presses the end of the sliver somewhat tangentially onto the opening roller, wherein the opening roller housing comprises at least two housing parts, and wherein the sliver support is exchangeably mounted on both housing parts.

2. A feeding and opening device according to claim 1, wherein the sliver support is clamped between the two housing parts without leaving a gap.

3. A feeding and opening device according to claim 2, wherein each housing part has a supporting surface for a lateral surface of the sliver support, and wherein the distance between the supporting surfaces corresponds to the effective width of the sliver support.

4. A feeding and opening device according to claim 3, wherein the distance between the supporting surfaces is bridged over by two through bolts which are mounted in the housing parts.

5. A feeding and opening device according to claim 4, wherein a through bore hole of the sliver support is arranged for one of said through bolts, and wherein a shell-shaped guiding surface of the sliver support is arranged at the other through bolt.

6. A feeding and opening device according to claim 5, wherein one housing part serves essentially to support the opening roller and the other housing part serves essentially to cover the periphery of the opening roller.

7. A feeding and opening device according to claim 4, wherein one housing part serves essentially to support the opening roller and the other housing part serves essentially to cover the periphery of the opening roller.

8. A feeding and opening device according to claim 3, wherein one housing part serves essentially to support the opening roller and the other housing part serves essentially to cover the periphery of the opening roller.

9. A feeding and opening device according to claim 2, wherein one housing part serves essentially to support the opening roller and the other housing part serves essentially to cover the periphery of the opening roller.

10. A feeding and opening device according to claim 1, wherein one housing part serves essentially to support the opening roller and the other housing part serves essentially to cover the periphery of the opening roller.

11. An open-end spinning assembly comprising:

a sliver feed roller, an opening roller downstream of the sliver feed roller, a feed table supporting sliver against the sliver feed roller during spinning operations, a sliver support member fixedly disposable between the feed table and opening roller, and an opening roller housing comprising first and second housing parts which form an exchangeable mounting support of the sliver support member.

12. An assembly according to claim 11, wherein the sliver support member is clamped between the first and second housing parts.

13. A method of making an open-end spinning assembly comprising:

a sliver feed roller, an opening roller downstream of the sliver feed roller, a feed table supporting sliver against the sliver feed roller, a sliver support member fixedly disposable between the feed table and opening roller, and an opening roller housing comprising first and second housing parts, said method comprising detachably clamping the sliver support member between the first and second housing parts.

14. A method according to claim 13, wherein said detachably clamping includes utilization of at least one threaded clamping member extending through a through hole in said sliver support.

* * * * *